US005773924A

United States Patent [19]

Nakamura

[11] Patent Number: 5,773,924

[45] Date of Patent: Jun. 30, 1998

[54] COLOR CATHODE RAY TUBE WITH AN INTERNAL MAGNETIC SHIELD

[75] Inventor: Kouji Nakamura, Tokyo, Japan

[73] Assignee: Mitsubishi Denki Kabushiki Kaisha, Tokyo, Japan

[21] Appl. No.: 691,560

[22] Filed: Aug. 2, 1996

[30] Foreign Application Priority Data

Nov. 27, 1995 [JP] Japan ..... 7-307134

[51] Int. Cl.[6] ..... H01J 29/06

[52] U.S. Cl. ..... 313/402; 313/479

[58] Field of Search ..... 313/402, 407, 313/479; 315/85; 174/35 R, 35 MS; 445/1, 8

[56] References Cited

U.S. PATENT DOCUMENTS 5,336,962 8/1994 Keller ..... 313/402
5,363,010 11/1994 Van Mensvoort ..... 313/402

FOREIGN PATENT DOCUMENTS 5-159713 6/1993 Japan ..... H01J 29/02

*Primary Examiner*—Michael Horabik
*Assistant Examiner*—Michael Day

[57] ABSTRACT

A color cathode ray tube includes an envelope having a front panel and a funnel joined to periphery of the front panel; a phosphor screen disposed on an inner surface of the front panel; a shadow mask disposed to face the phosphor screen and having a plurality of apertures for passing electron beams; an electron gun disposed in a neck of the funnel and emitting the electron beams toward the shadow mask; and a magnetic shield disposed within the envelope and surrounding a path along which the electron beams travel. The magnetic shield has a first side plate, a third side plate facing the first side plate, a second side plate, a fourth side portion facing the second side plate, a first opening on the side of the shadow mask, and a second opening on the side of the electron gun, thereby forming almost a hollow frustum of quadrangular pyramid, and only each of the first and third side plates has notches in the vicinity of both ends of edges of the first and third side plates on the side of the second opening.

10 Claims, 8 Drawing Sheets

COLOR CATHODE RAY TUBE WITH AN INTERNAL MAGNETIC SHIELD

BACKGROUND OF THE INVENTION

The present invention relates to a color cathode ray tube having an inner magnetic shield for reducing the effect of an external magnetic field such as terrestrial magnetism on the electron beam.

FIG. 9 and FIG. 10 are perspective views schematically showing the shapes of inner magnetic shields for a conventional color cathode ray tube shown in Japanese Patent Kokai Publication No. 159713/1993. General methods for reducing the electromagnetic force exerted by terrestrial magnetism on the electron beam include reducing the number of the lines of magnetic force intersecting the electron beam by terrestrial magnetism and decreasing the angle between the electron beam and the lines of magnetic force intersecting the electron beam so that a direction of the lines of magnetic force produced by terrestrial magnetism approaches a direction parallel to the electron beam.

The magnetic shield 40 in FIG. 9 has a function to reduce the number of the lines of magnetic force intersecting the electron beam EB emitted in the direction of the tube axis (Z-axis direction), by effectively shielding terrestrial magnetism in the horizontal direction (X-axis direction) which is hereafter referred to as E/W terrestrial magnetism. This magnetic shield 40, however, cannot sufficiently reduce the effect of terrestrial magnetism in the direction of tube axis (hereafter referred to as N/S terrestrial magnetism) on the electron beam EB, which would be about three times greater than the effect of E/W terrestrial magnetism.

To solve the problem, the magnetic shield 41 shown in FIG. 10 was devised. This magnetic shield 41 has notches 42*a* to 45*a*, each of which is formed at the center of each edge of the four side plates 42 to 45, thereby making the direction of the lines of magnetic force produced by N/S terrestrial magnetism close to a direction parallel to the electron beam EB and consequently reducing the effect of electromagnetic force exerted by N/S terrestrial magnetism on electron beam EB.

However, the magnetic shield 41 having the notches 42*a* to 45*a* around the center of each edge of the side plates 42 to 45, as shown in FIG. 10, has a high shielding effect against N/S terrestrial magnetism in the angular sections (sections in the vicinity of edges where the side plates 42 to 45 constituting the magnetic shield intersect), but has an insufficient shielding effect against N/S terrestrial magnetism in the vicinity of the ends of the X-axis and Y-axis of the opening on the side of the shadow mask (in the vicinity of both ends of the X-axis and Y-axis on the screen display, where the X-axis is the horizontal axis, Y-axis is the vertical axis, and the origin of the coordinate system is at the center of the screen display surface).

SUMMARY OF THE INVENTION

An object of the invention is to provide a color cathode ray tube which suppresses the effect of N/S terrestrial magnetism on the electron beam, thereby achieving good landing of the electron beam.

According to the present invention, a color cathode ray tube comprises an envelope having a front panel and a funnel joined to periphery of the front panel; a phosphor screen disposed on an inner surface of the front panel; a shadow mask disposed to face the phosphor screen and having a plurality of apertures for passing electron beams; an electron gun disposed in a neck of the funnel and emitting the electron beams toward the shadow mask; and a magnetic shield disposed within the envelope and surrounding a path along which the electron beams travel. The magnetic shield has a first side plate, a third side plate facing the first side plate, a second side plate, a fourth side plate facing the second side plate, a first opening on the side of the shadow mask, and a second opening on the side of the electron gun, thereby forming almost a hollow frustum of quadrangular pyramid, and only each of the first and third side plates has notches in the vicinity of both ends of edges of the first and third side plates on the side of the second opening. The effect of E/W terrestrial magnetism on the electron beam is suppressed and, at the same time, the effect of N/S terrestrial magnetism on the electron beam can be reduced further. As a result, good landing of electron beams can be achieved, and high-quality pictures can be displayed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

First Embodiment

Figure 1:
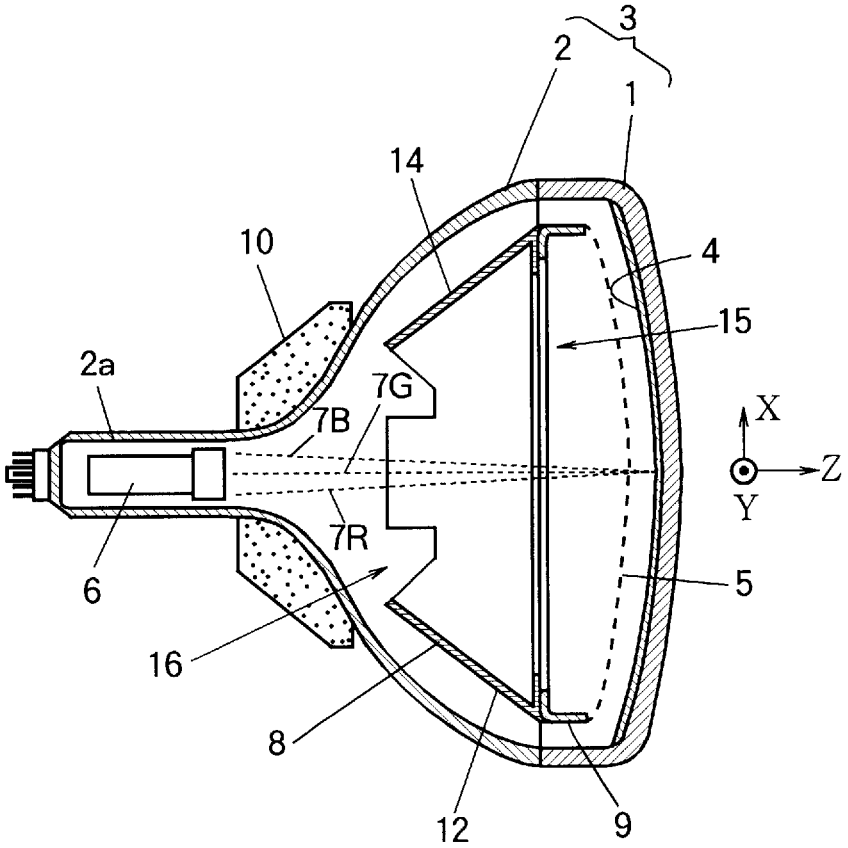
FIG. 1 is a horizontal sectional view schematically showing structure of a color cathode ray tube of the first embodiment according to the present invention.

FIG. 1 is a horizontal sectional view schematically showing the structure of the first embodiment of the color cathode ray tube according to the present invention. As shown in FIG. 1, the color cathode ray tube according to the first embodiment has an envelope 3 consisting of a glass front panel 1 which is almost rectangular when viewed from the front (right side on FIG. 1) and a glass funnel 2 joined to periphery of the front panel 1. The color cathode ray tube contains a phosphor screen 4 which is disposed on the inner surface of the front panel 1 and which consists of phosphor layers of three colors that glow in red, green, and blue, and a shadow mask 5 which is disposed to face the phosphor screen 4 and which has a number of apertures for passing electron beams. Furthermore, the color cathode ray tube is provided with an electron gun 6 which is disposed in the neck 2*a* of the funnel 2 and which emits three electron beams 7R, 7G, and 7B toward the shadow mask 5, and a magnetic shield 8 which is disposed to surround the traveling path of the electron beams within the envelope 3 and which shields the external magnetic field produced by terrestrial magnetism, external circuits and the like. In FIG. 1, the reference numeral 9 denotes a frame supporting the shadow mask 5 and the magnetic shield 8, and the reference numeral 10 denotes a deflection yoke for deflecting the electron beams 7R, 7G, and 7B.

Figure 2A:
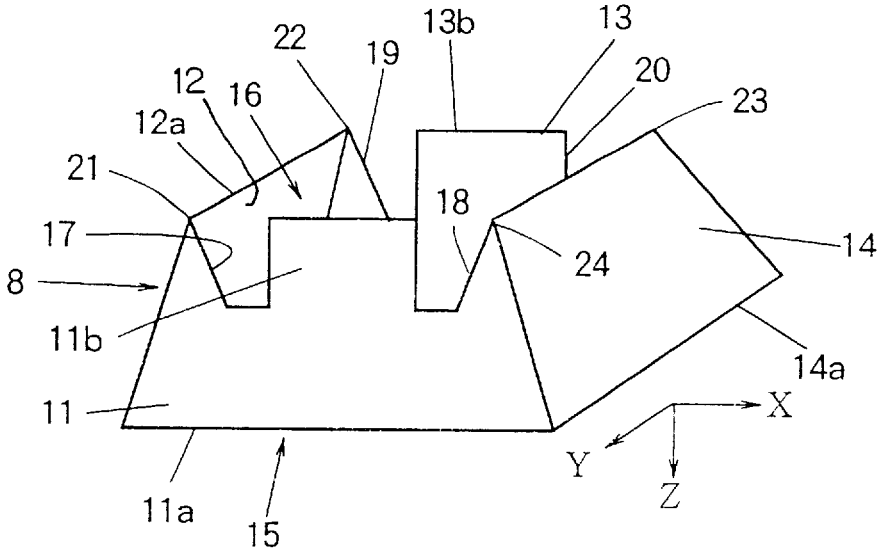
FIG. 2A is a perspective view showing the magnetic shield shown in FIG. 1.
Figure 2B:
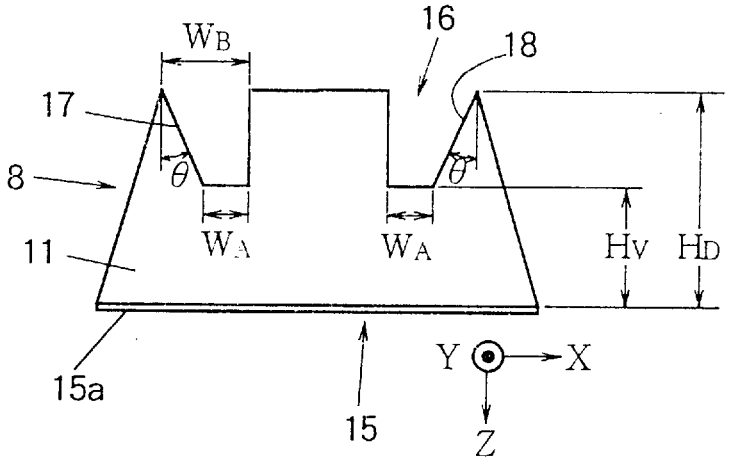
FIG. 2B is an explanatory diagram showing the notches of the magnetic shield shown in FIG. 1.

FIG. 2A is a perspective view showing the shape of the magnetic shield 8 and FIG. 2B is an explanatory diagram showing the notches of the magnetic shield 8. The magnetic shield 8 is formed of a magnetic metal plate of about 0.1 [mm] to 0.3 [mm] thick. Materials suitable for the magnetic metal plate include rimmed steel and aluminum killed steel, but other magnetic materials may also be used. As shown in FIG. 2A, the magnetic shield 8 is hollow and shaped like a frustum of quadrangular pyramid, and has a first side plate (top side plate) 11 slanting from the X-Z plane (horizontal plane), a third side plate (bottom side plate) 13 slanting from the X-Z plane and facing the first side plate 11, a second side plate (left side plate) 12 slanting from the Y-Z plane (vertical plane), and a fourth side plate (right side plate) 14 slanting from the Y-Z plane and facing the second side plate 12. As shown in FIGS. 1, 2A and 2B, the magnetic shield 8 has a first large opening 15 on the side of the shadow mask 5 and a second small opening 16 on the side of the electron gun 6. In a color cathode ray tube having a wide screen (longer horizontal dimension), the edges of the first side plate 11 and the third side plate 13 on the side of the first opening 15 (edge 11*a* in FIG. 2A, for example), that is the edges extending in the X direction, are longer than the edges of the second side plate 12 and the fourth side plate 14 on the side of the first opening 15 (edge 14*a* in FIG. 2A, for example), that is the edges extending in the Y direction. The first to fourth side plates 11 to 14 may be flat or curved.

The magnetic shield 8 in the first embodiment has notches 17 and 18 in the vicinity of both ends of the edge of the first side plate 11 on the side of the second opening 16 and notches 19 and 20 in the vicinity of both ends of the edge of the third side plate 13 on the side of the second opening 16.

The pair of the notches 17 and 18 and the pair of the notches 19 and 20 are formed on the first side plate 11 and the third side plate 13 respectively, in order to focus the lines of magnetic force produced by N/S terrestrial magnetism and entering from the second opening 16 to the angular corners 21 to 24 on the side of the second opening 16 where the side plates 11 to 14 meet, decreasing the angle between the direction of the lines of magnetic force produced by N/S terrestrial magnetism and the direction of the electron beam, thereby reducing the effect of N/S terrestrial magnetism on the electron beam.

The notches 17 and 18 are formed in the vicinity of both ends of the edge of the first side plate 11, leaving a protrusion 11*b* between the pair of the notches 17 and 18, and the notches 19 and 20 are formed in the vicinity of both ends of the edge of the third side plate 13, leaving a protrusion 13*b* between the pair of the notches 19 and 20, in order to reduce the number of the lines of magnetic force intersecting the electron beam in the vicinity of the ends of the X-axis and Y-axis (in the vicinity of both ends of the X-axis and Y-axis on the screen display, where the X-axis is the horizontal axis, Y-axis is the vertical axis, and the origin of the coordinate system is at the center of the screen display surface) on the first side plate 11 and to reduce the number of the lines of magnetic force intersecting the electron beam in the vicinity of the ends of the X-axis and Y-axis on the third side plate 13. In other words, the purpose is to improve the effect of shielding N/S terrestrial magnetism in the vicinity of the ends of the X-axis and Y-axis, which is insufficient with the conventional magnetic shield in which a notch is disposed at the center of the individual side plates constituting the magnetic shield (for example, shown in FIG. 10).

As described above, the color cathode ray tube of the first embodiment can reduce the effect of N/S terrestrial magnetism on the electron beam while suppressing the effect of E/W terrestrial magnetism on the electron beam.

Figure 3:
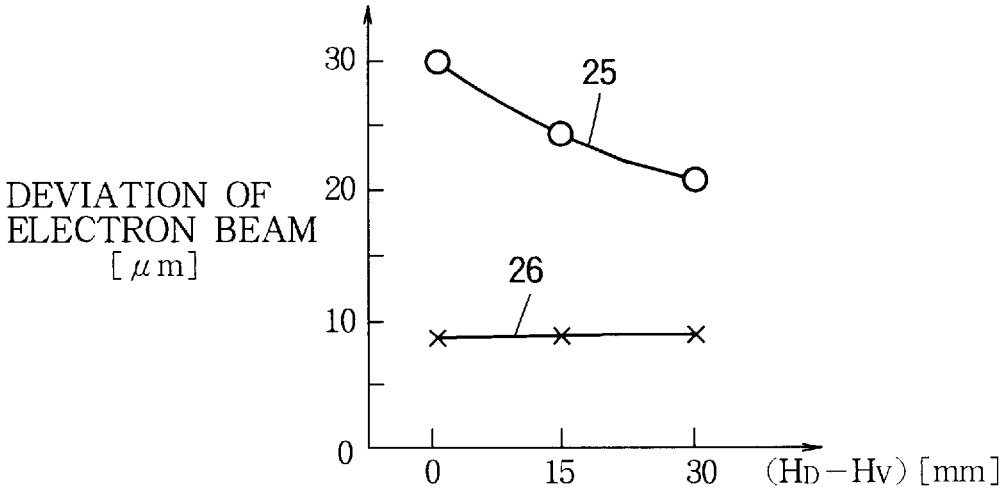
FIG. 3 is a graph showing the relationships between the depth of the notches ($H_D$–$H_V$) and the deviation of the electron beam under the influence of N/S terrestrial magnetism.

FIG. 3 is a graph showing the relationships between the depth of the notches 17 to 20 ($H_D$–$H_V$) and the deviation of the electron beam under the influence of N/S terrestrial magnetism, concerning the color cathode ray tube of the first embodiment. $H_D$ represents the height of the edge of the second opening 16 of the magnetic shield 8 from the reference plane 15*a* containing the first opening 15. $H_V$ represents the height of the bottom of the notches 17 to 20 from the reference plane 15*a*. In FIG. 3, the curve 25 represents the relationship between the maximum deviation of the electron beam [$\mu$m] in the angular sections and the depth ($H_D$–$H_V$) of the notches 17 to 20, and the curve 26 represents the relationship between the maximum deviation of the electron beam [$\mu$m] in the vicinity of the ends of the X-axis and Y-axis and the depth of the notches 17 to 20 ($H_D$–$H_V$). It is apparent from the curve 25 in FIG. 3 that the maximum deviation of the electron beam [$\mu$m] in the angular sections decreases as the depth ($H_D$–$H_V$) of the notches 17 to 20 increases. It is clear from the curve 26 in FIG. 3 that an increase in the depth ($H_D$–$H_V$) of the notches 17 to 20 hardly increases the deviation of the electron beam [$\mu$m] in the vicinity of the ends of the X-axis and Y-axis.

Figure 4:
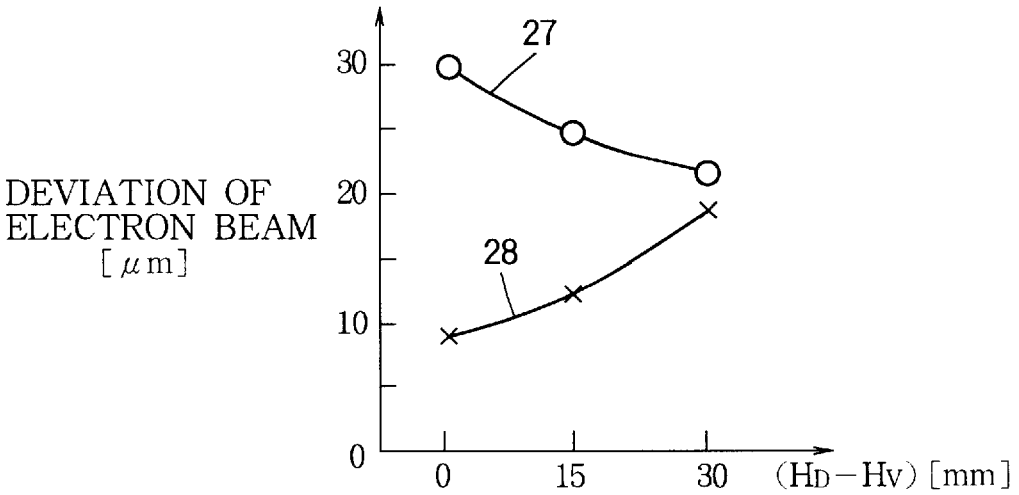
FIG.4 PRIOR ART
FIG. 4 is a graph showing the relationships between the depth of the notches and the deviation of the electron beam under the influence of N/S terrestrial magnetism, concerning the conventional magnetic shield.
Figure 10:
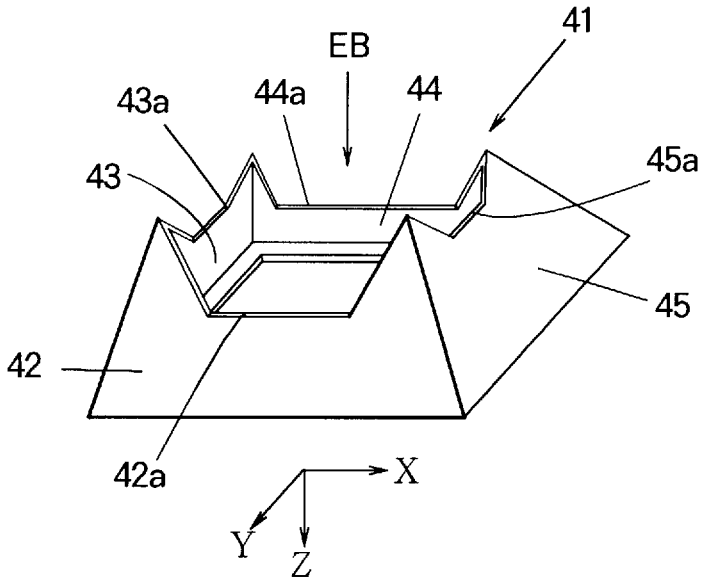
FIG. 10 PRIOR ART
FIG. 10 is a perspective view schematically showing another shape of the conventional magnetic shield.

FIG. 4 is a graph showing the relationships between the depth of the notches and the deviation of the electron beam under the influence of N/S terrestrial magnetism, concerning the conventional magnetic shield shown in FIG. 10. In FIG. 4, the curve 27 represents the relationship between the maximum deviation of the electron beam [$\mu$m] in the angular sections and the depth of the notches. The curve 28 represents the relationship between the deviation of the electron beam [$\mu$m] in the vicinity of the ends of the X-axis and Y-axis and the depth of the notches. It is clear from the curve 27 in FIG. 4 that the maximum deviation of the electron beam [$\mu$m] decreases as the depth of the notches increases. It is apparent from the curve 28 that an increase in the depth of the notches increases the deviation of the electron beam [$\mu$m] in the vicinity of the ends of the X-axis and Y-axis.

The values indicated in FIGS. 3 and 4 were obtained from experiments. In the experiments, a magnetic shield for a 15 inches CRT (a product of Mitsubishi Electric Corporation) was used. The dimensions of the magnetic shield are as follows:

Width of first opening in the X-axis direction=280 [mm]

Width of second opening in the X-axis direction=126 [mm]

Width $W_A$ of bottom of notch=10 [mm]

Maximum width $W_B$ of notch=46 [mm]

Height $H_D$ of first and third side plates 11, 13=84 [mm]

Height $H_V$ of bottom of notches 17–20=54 [mm] or 69 [mm]

In the first embodiment, the shape, depth ($H_D$–$H_V$), width $W_A$ (width at the bottom), and width $W_B$ (maximum width) of the notches 17 to 20, height $H_D$ of the first side plate 11 and the third side plate 13, height $H_V$ of the bottom of the notches 17 to 20, the ratio of the height $H_V$ to the height $H_D$ (i.e., $H_V/H_D$), and the angle θ of the slanting edge of the notches 17 to 20 may be determined according to the shape, size and other conditions of the color cathode ray tube, environmental conditions under which the color cathode ray tube is used, and design requirements such as whether priority is given to the shielding of the influence of N/S terrestrial magnetism or E/W terrestrial magnetism. The angle θ of the slanting edge of the notches 17 to 20 is desired to satisfy the following inequality:

$$0° \leqq \theta \leqq 60° \quad (1)$$

The height $H_V$ of the bottom of the notches 17 to 20 is desired to satisfy the following inequality:

$$0.3 \times H_D \leqq H_V \leqq 0.7 \times H_D \quad (2)$$

In the explanation above, the notches are formed on the longer edges of the second opening 16 of the magnetic shield 8. However, the effect of the external magnetism can be reduced by forming the notches in the vicinity of the ends of the shorter edges of the second opening 16.

Second Embodiment

Figure 5A:
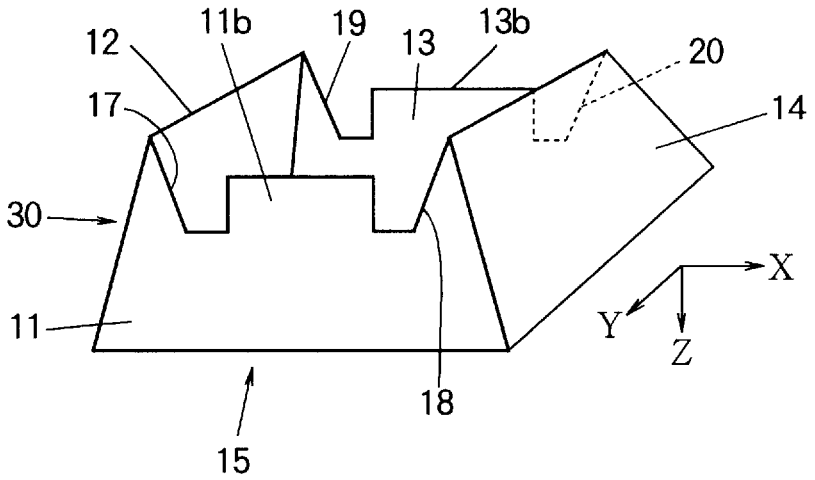
FIG. 5A is a perspective view showing the magnetic shield of the second embodiment.
Figure 5B:
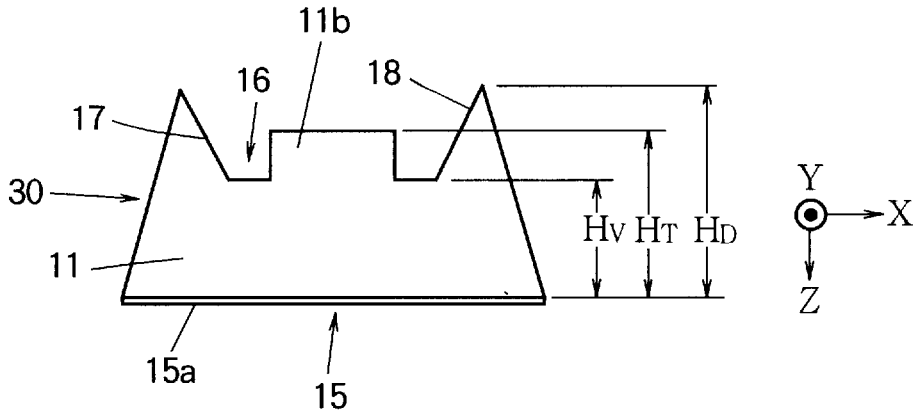
FIG. 5B is an explanatory diagram showing the notches of the magnetic shield.

FIGS. 5A and 5B show the magnetic shield 30 of the second embodiment of the color cathode ray tube according to the present invention, wherein FIG. 5A is a perspective view showing the shape of the magnetic shield 30 and FIG. 5B is an explanatory diagram showing the notches of the magnetic shield 30. This magnetic shield 30 is different from the magnetic shield of the first embodiment only in that the height $H_T$ of the edge on the side of the second opening 16 of the protrusion 11*b* between the notches 17 and 18 and the protrusion 13*b* between the notches 19 and 20 from the reference plane 15*a* is smaller than the height $H_D$ of the edge on the side of the second opening 16 of the second side plate 12 and the fourth side plate 14 from the reference plane 15*a*. The second embodiment can improve the shielding effect in the vicinity of the ends of the X-axis and Y-axis as much as the first embodiment. The second embodiment can further improve the shielding effect in the angular sections. In other respects, the second embodiment is identical to the first embodiment.

Third Embodiment

Figure 6A:
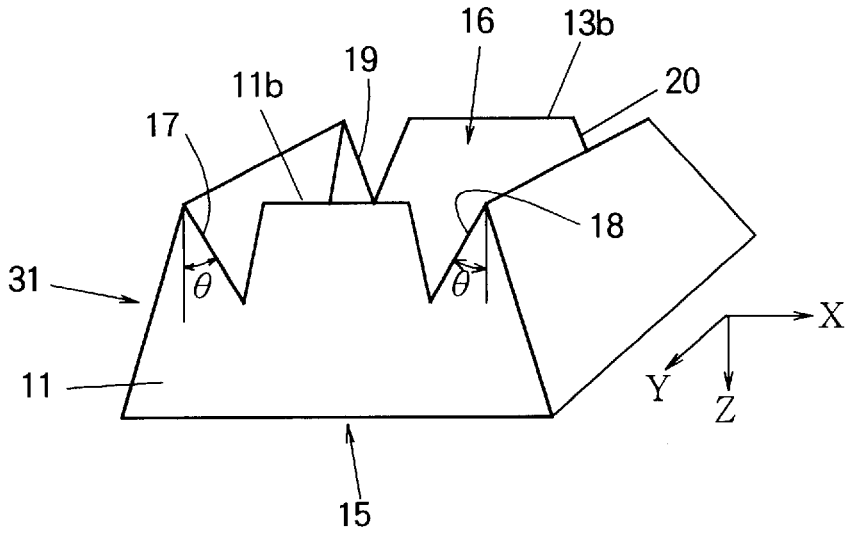
FIG. 6A is a perspective view showing the magnetic shield of the third embodiment.
Figure 6B:
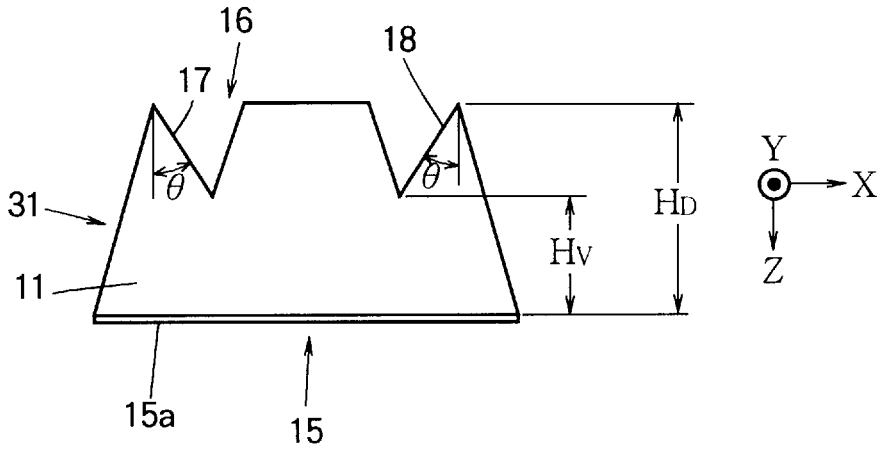
FIG. 6B is an explanatory diagram showing the notches of the magnetic shield.

FIGS. 6A and 6B show the magnetic shield 31 of the third embodiment of the color cathode ray tube according to the present invention, wherein FIG. 6A is a perspective view showing the shape of the magnetic shield 31 and FIG. 6B is an explanatory diagram showing the notches of the magnetic shield 31. The magnetic shield 31 of the third embodiment is different from the magnetic shield of the first embodiment only in that the notches 17 to 20 are V-shaped. The third embodiment is as effective as the first embodiment. If the notches have identical depths, the first side plate 11 and the third side plate 13 are immune to being deformed. In other respects, the third embodiment is the same as the first embodiment.

Fourth Embodiment

Figure 7A:
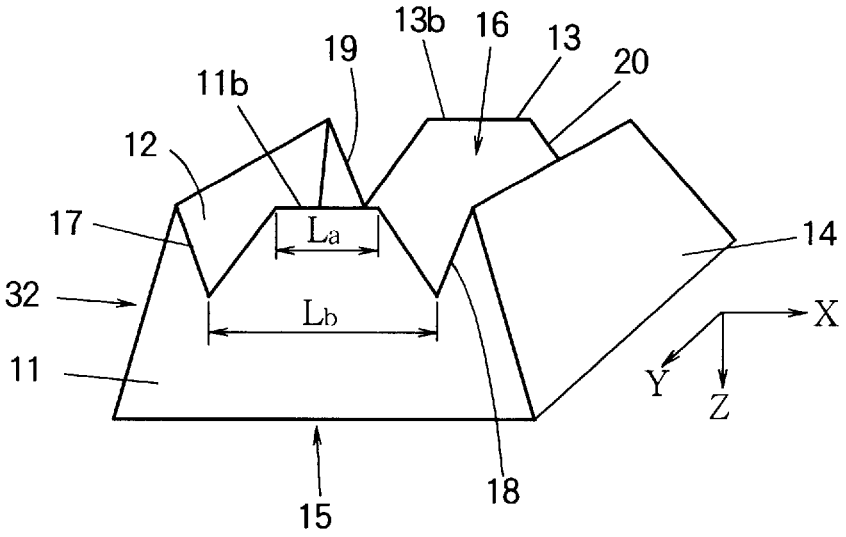
FIG. 7A is a perspective view showing the magnetic shield of the fourth embodiment.
Figure 7B:
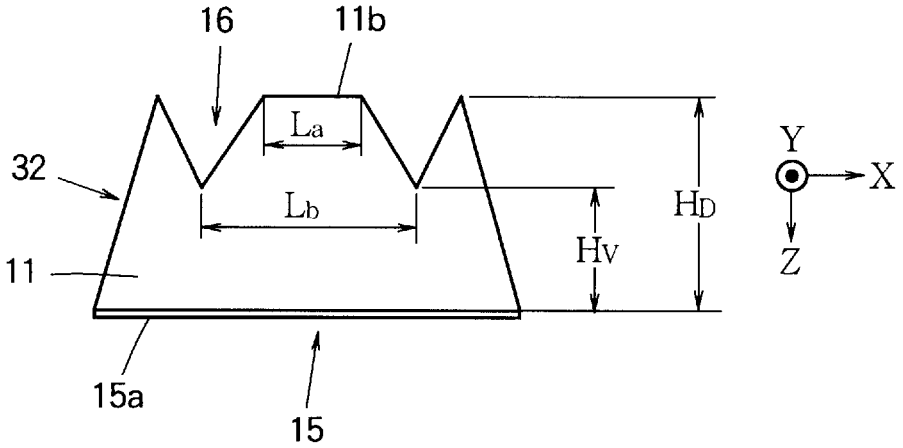
FIG. 7B is an explanatory diagram showing the notches of the magnetic shield.

FIGS. 7A and 7B show the magnetic shield 32 of the fourth embodiment of the color cathode ray tube according to the present invention, wherein FIG. 7A is a perspective view showing the shape of the magnetic shield 32 and FIG. 7B is an explanatory diagram showing the notches of the magnetic shield 32. The magnetic shield 32 of the fourth embodiment is different from the magnetic shield of the first embodiment only in that the notches 17 to 20 are V-shaped and that the length $L_a$ of the upper edge of the protrusions 11*b* and 13*b* on the first side plate 11 and the third side plate 13 is not greater than a half of the distance $L_b$ between the notches 17 and 18 and between the notches 19 and 20 at the deepest part. The fourth embodiment enhances the shielding effect in the vicinity of the ends of the X-axis and Y-axis in the same manner as the first embodiment does, and further improves the shielding effect in the angular sections. In other respects, the fourth embodiment is the same as the first embodiment.

Fifth Embodiment

Figure 8A:
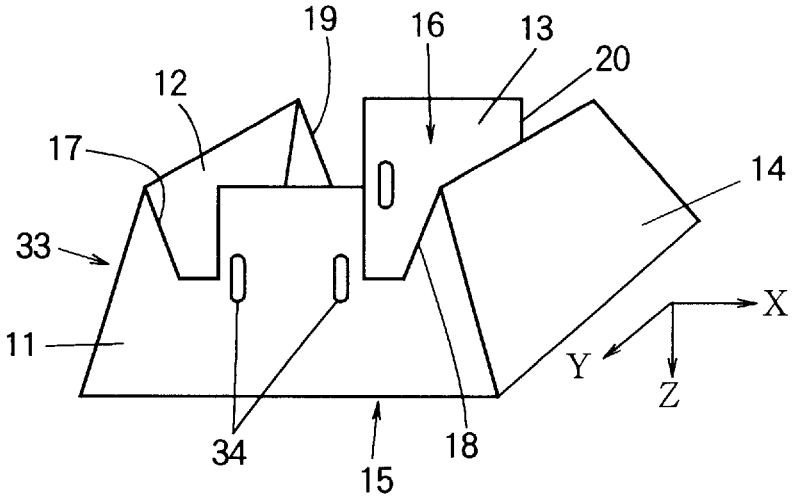
FIG. 8A is a perspective view showing the magnetic shield of the fifth embodiment.
Figure 8B:
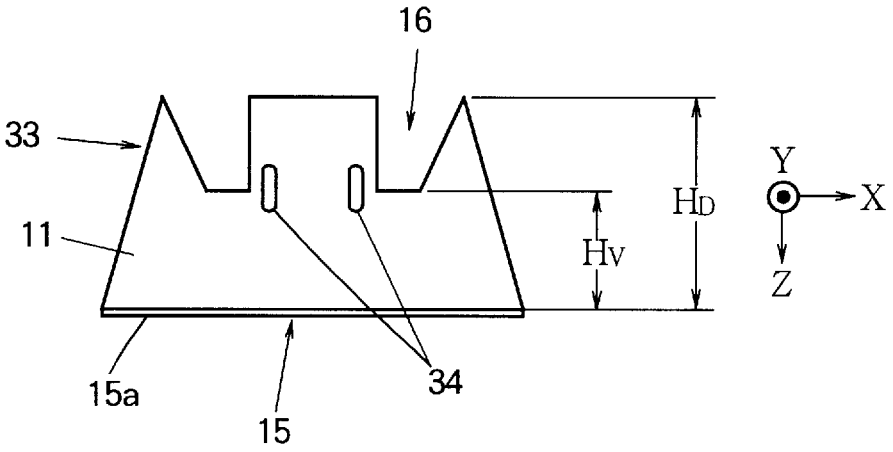
FIG. 8B is an explanatory diagram showing the notches of the magnetic shield.
Figure 9:
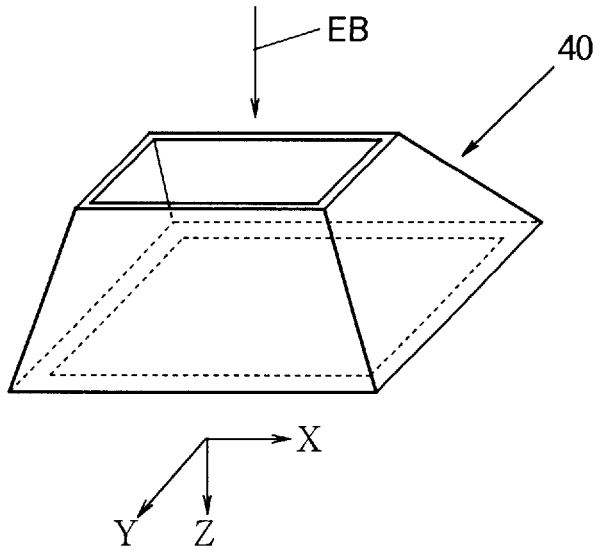
FIG. 9 PRIOR ART
FIG. 9 is a perspective view schematically showing a shape of the conventional magnetic shield.

FIGS. 8A and 8B show the magnetic shield 33 of the fifth embodiment of the color cathode ray tube according to the present invention, wherein FIG. 8A is a perspective view showing the shape of the magnetic shield 33 and FIG. 8B is an explanatory diagram showing the notches of the magnetic shield 33. The magnetic shield 33 of the fifth embodiment is different from the magnetic shield of the first embodiment only in that beads 34 for mechanical reinforcement are disposed in the vicinity of the notches 17 to 20. The fifth embodiment is as effective as the first embodiment. In other respects, the fifth embodiment is the same as the first embodiment.

What is claimed is:

1. A color cathode ray tube comprising:

an envelope having a front panel and a funnel joined to the periphery of said front panel;

a phosphor screen disposed on an inner surface of said front panel;

a shadow mask disposed to face said phosphor screen and having a plurality of apertures for passing electron beams;

an electron gun disposed in a neck of said funnel and emitting said electron beams toward said shadow mask; and a magnetic shield disposed within said envelope and surrounding a path along which said electron beams travel;

wherein said magnetic shield has a first side plate, a third side plate facing said first side plate, a second side plate, a fourth side plate facing said second side plate, a first opening on the side of said shadow mask, and a second opening on the side of said electron gun, thereby forming almost a hollow frustum of a quadrangular pyramid, only each of said first and third side plates having notches in the vicinity of both ends of an edge thereof on the side of said second opening, the edge of the first side plate between the notches on the side of the second opening having a straight portion parallel to another edge of the first side plate on the side of the first opening, and the edge of the third side plate between the notches on the side of the second opening having a straight portion parallel to another edge of the third side plate on the side of the first opening.

2. A color cathode ray tube according to claim 1, wherein height of edge of said first side plate between said notches on the side of said second opening from a reference plane containing said first opening is smaller than height of highest edge of said second opening from said reference plane, and height of edge of said third side plate between said notches on the side of said second opening from said reference plane is smaller than height of highest edge of said second opening from said reference plane.

3. A color cathode ray tube according to claim 1, wherein said notches are shaped like a letter V.

4. A color cathode ray tube according to claim 1, wherein an edge of said first side plate between said notches on the side of said second opening has a length greater than zero but not greater than half of a distance between said notches on said first side plate at a deepest part of said notches, and an edge of said third side plate between said notches on the side of said second opening has a length greater than zero but not greater than half of a distance between said notches on said third side plate at a deepest part of said notches.

5. A color cathode ray tube according to claim 1, further comprising reinforcing members in the vicinity of said notches on said first side plate and said third side plate.

6. A color cathode ray tube comprising:

an envelope having a front panel and a funnel joined to the periphery of said front panel;

a phosphor screen disposed on an inner surface of said front panel;

a shadow mask disposed to face said phosphor screen and having a plurality of apertures for passing electron beams;

an electron gun disposed in a neck of said funnel and emitting said electron beams toward said shadow mask; and a magnetic shield disposed within said envelope and surrounding a path along which said electron beams travel;

wherein said magnetic shield has a first side plate, a third side plate facing said first side plate, a second side plate, a fourth side plate facing said second side plate, a first opening on the side of said shadow mask, and a second opening on the side of said electron gun, thereby forming almost a hollow frustum of a quadrangular pyramid, only each of said first and third side plates having notches in the vicinity of both ends of an edge thereof on the side of said second opening, a bottom of each of the notches of the first side plate having a straight portion parallel to the edge of the first side plate on the side of the first opening, and a bottom of each of the notches of the third side plate having a straight portion parallel to the edge of the third side plate on the side of the first opening.

7. A color cathode ray tube according to claim 6, wherein the height of the edge of said first side plate between said notches on the side of said second opening from a reference plane containing said first opening is smaller than the height of the highest edge of said second opening from said reference plane, and the height of the edge of said third side plate between said notches on the side of said second opening from said reference plane is smaller than the height of the highest edge of said second opening from said reference plane.

8. A color cathode ray tube according to claim 6, wherein said notches are shaped like an inverted trapezoid.

9. A color cathode ray tube according to claim 6, wherein an edge of said first side plate between said notches on the side of said second opening has a length greater than zero but not greater than half of a distance between said notches on said first side plate at a deepest part of said notches, and an edge of said third side plate between said notches on the side of said second opening has a length greater than zero but not greater than half of a distance between said notches on said third side plate at a deepest part of said notches.

10. A color cathode ray tube according to claim 6, further comprising reinforcing members in the vicinity of said notches on said first side plate and said third side plate.

* * * * *